US009024682B2

(12) United States Patent
Krnic et al.

(10) Patent No.: US 9,024,682 B2
(45) Date of Patent: May 5, 2015

(54) PROPORTIONAL-TO-SUPPLY ANALOG CURRENT GENERATOR

(71) Applicant: ATI Technologies ULC, Markham (CA)

(72) Inventors: Boris Krnic, Toronto (CA); James Lin, Richmond Hill (CA)

(73) Assignee: ATI Technologies, ULC, Markham, Ontario (CA)

( * ) Notice: Subject to any disclaimer, the term of this patent is extended or adjusted under 35 U.S.C. 154(b) by 0 days.

(21) Appl. No.: 14/010,992

(22) Filed: Aug. 27, 2013

(65) Prior Publication Data

US 2015/0061747 A1 Mar. 5, 2015

(51) Int. Cl.
*G05F 3/02* (2006.01)
*G06G 7/14* (2006.01)

(52) U.S. Cl.
CPC ..... *G06G 7/14* (2013.01)

(58) Field of Classification Search
USPC ..... 327/530–546; 323/312–317
See application file for complete search history.

(56) References Cited

U.S. PATENT DOCUMENTS

| | | | | |
|---|---|---|---|---|
| 5,631,600 | A * | 5/1997 | Akioka et al. | 327/543 |
| 2006/0125460 | A1* | 6/2006 | Mheen et al. | 323/313 |
| 2009/0189684 | A1* | 7/2009 | Gouin | 327/543 |
| 2011/0080145 | A1* | 4/2011 | Tsukuda | 323/234 |
| 2012/0113737 | A1* | 5/2012 | Lee et al. | 365/226 |

* cited by examiner

*Primary Examiner* — Brandon S Cole
(74) *Attorney, Agent, or Firm* — Polansky & Associates P.L.L.C.; Paul J. Polansky

(57) ABSTRACT

A current generator includes first and second current generators and an output current generator. The first current generator has an output for providing a first current, the first current proportional to a difference between a first power supply voltage and a first gate-to-source voltage. The second current generator has an output for providing a second current, the second current proportional to a second gate-to-source voltage. The second gate-to-source voltage is approximately equal to the first gate-to-source voltage. The output current generator provides an output current proportional to a sum of said first current and said second current.

20 Claims, 3 Drawing Sheets

300

- PRIOR ART -

300

400

PROPORTIONAL-TO-SUPPLY ANALOG CURRENT GENERATOR

FIELD

This disclosure relates generally to reference circuits, and more specifically to current generators.

BACKGROUND

Most analog circuits require some form of bias voltage or bias current for operation. For example, an amplifier typically requires a reference voltage to bias a transistor to operate as a current source. Some reference circuits generate a voltage or current that varies in proportion to the value of a power supply voltage used elsewhere on the chip. An example of the use of a proportional-to-supply bias current is in biasing high-speed source-coupled logic gates and delay cells. A common method of obtaining a current that tracks the on-chip power supply voltage is to use a voltage divider to generate a reference voltage that is a fraction of the power supply voltage. This reference voltage is input to a voltage-to-current (i.e. transconductance) loop to provide an output current that is proportional to the input voltage, which is in turn a fraction of the power supply voltage. The transconductance loop is a negative feedback loop that relies on a gain element that is typically an operational amplifier. Operational amplifiers, however, are complex analog circuits that require a substantial amount of circuit area.

Figure 1:
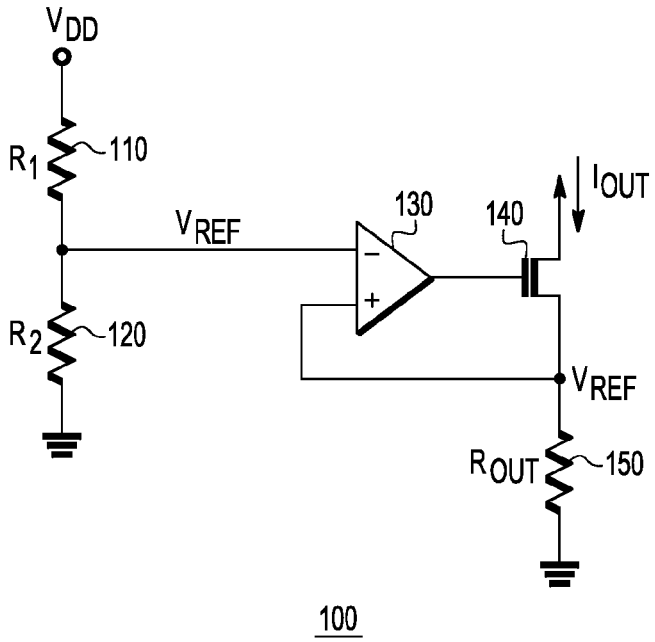
FIG. 1 illustrates in partial block diagram and partial schematic form a current generator known in the prior art.

In the following description, the use of the same reference numerals in different drawings indicates similar or identical items. Unless otherwise noted, the word "coupled" and its associated verb forms include both direct connection and indirect electrical connection by means known in the art, and unless otherwise noted any description of direct connection implies alternate embodiments using suitable forms of indirect electrical connection as well. The following description uses the term metal-oxide-semiconductor (MOS) field effect transistor to refer generically to any insulated gate field effect transistor, regardless of the composition of the gate, and thus includes silicon-gate field effect transistors.

DETAILED DESCRIPTION OF ILLUSTRATIVE EMBODIMENTS

FIG. 1 illustrates in partial block diagram and partial schematic form a current generator 100 known in the prior art. Current generator 100 includes resistors 110 and 120, an operational amplifier 130, an N-channel metal-oxide-semiconductor (MOS) transistor 140, and a resistor 150. Resistor 110 has a first terminal connected to a power supply voltage terminal labeled "$V_{DD}$", and a second terminal for developing a voltage labeled "$V_{REF}$", and has an associated resistance $R_1$. Resistor 120 has a first terminal connected to the second terminal of resistor 110, and a second terminal connected to ground which is at 0 volts, and has an associated resistance $R_2$. $V_{DD}$ is a more-positive power supply voltage terminal having a nominal value of, for example, 1.8 volts with respect to ground. Operational amplifier 130 has an inverting input connected to the second terminal of resistor 110, a non-inverting input, and an output. Transistor 140 has a drain for providing a current labeled "$I_{OUT}$", a gate connected to the output of operational amplifier 130, and a source connected to the non-inverting input of operational amplifier 130, which is also at $V_{REF}$ and is labeled as such. Resistor 150 has a first terminal connected to the second terminal of transistor 140, and a second terminal connected to ground, and has an associated resistance $R_{OUT}$.

Current generator 100 provides current $I_{OUT}$ equal to $V_{REF}$ divided by $R_{OUT}$. Operational amplifier 130 changes its output voltage to make the voltage at its input terminals equal. As it changes its output voltage, it modulates the conductivity of transistor 140 until the voltage at its source is equal to $V_{REF}$. Resistors 110 and 120 form a voltage divider, and as $V_{DD}$ varies, the voltage at the second terminal of resistor 110 varies, and therefore $V_{REF}$ and $I_{OUT}$ depend on power supply voltage $V_{DD}$:

$$I_{OUT} = \frac{V_{REF}}{R_{OUT}} = \frac{V_{DD} * R_2}{R_{OUT} * (R_1 + R_2)} \quad [1]$$

Thus output current $I_{OUT}$ is proportional to $V_{DD}$.

While current generator 100 is sufficient for most applications that require a current that is proportional to the power supply voltage, it requires a significant amount of circuit area. For example, an ideal operational amplifier has infinite input impedance, zero output impedance, and infinite gain. To implement an operational amplifier with desirable, i.e. near-ideal characteristics, operational amplifier 130 requires proper bias voltages and a sophisticated circuit design for stability in closed loop circuits such as current generator 100. To generate the proper bias voltages, operational amplifier 130 needs complex bias circuits such as a bandgap reference circuits to generate temperature-stable bias voltages. Moreover operational amplifier 130 needs to be compensated by using large, on-chip capacitors to ensure loop stability. Both considerations cause current generator 100 to consume a significant amount of circuit area.

Figure 2:
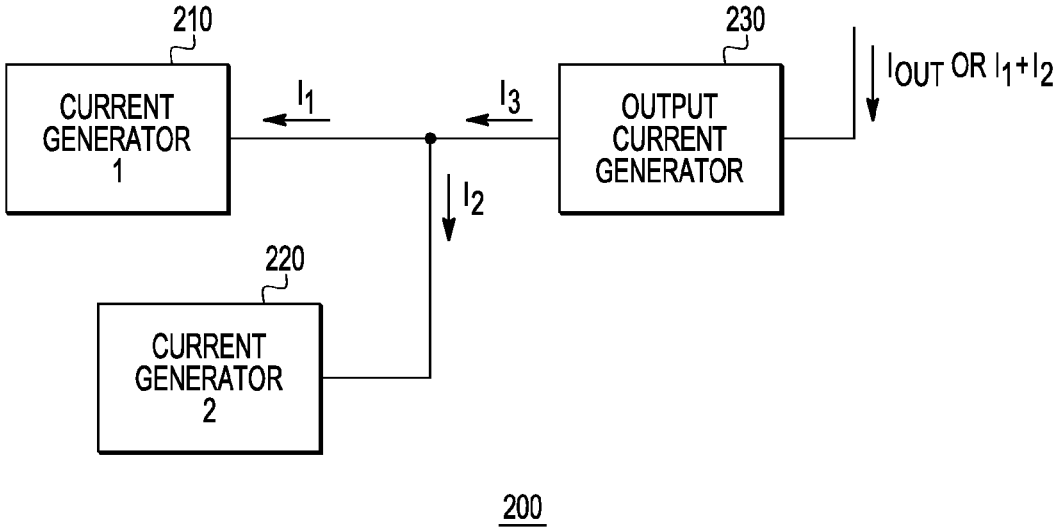
FIG. 2 illustrates in block diagram form a current generator according to some embodiments.

FIG. 2 illustrates in block diagram form a current generator 200 according to some embodiments. Current generator 200 includes a first current generator 210 labeled "CURRENT GENERATOR 1", a second current generator 220 labeled "CURRENT GENERATOR 2", and an output current generator 230 labeled "OUTPUT CURRENT GENERATOR". Current generator 210 provides a current labeled "$I_1$" that is proportional to a difference between a first power supply voltage such as $V_{DD}$ and a gate-to-source voltage of a transistor. Current generator 220 provides a current labeled "$I_2$" that is proportional to the gate-to-source voltage of another transistor that is matched in size and layout to the transistor in current generator 210, or preferably, to the same transistor. These two currents are summed at a common node to produce a current labeled "$I_3$" that is equal to $I_1+I_2$. Since the components of the current that are related to the gate-to-source voltage of the two transistors cancel out, current $I_3$ is dependent only on the supply voltage. Output current generator 230 provides a current that is proportional to $I_3$, and as will be seen below, can increase or decrease the magnitude of the current while remaining proportional to $V_{DD}$.

Figure 3:
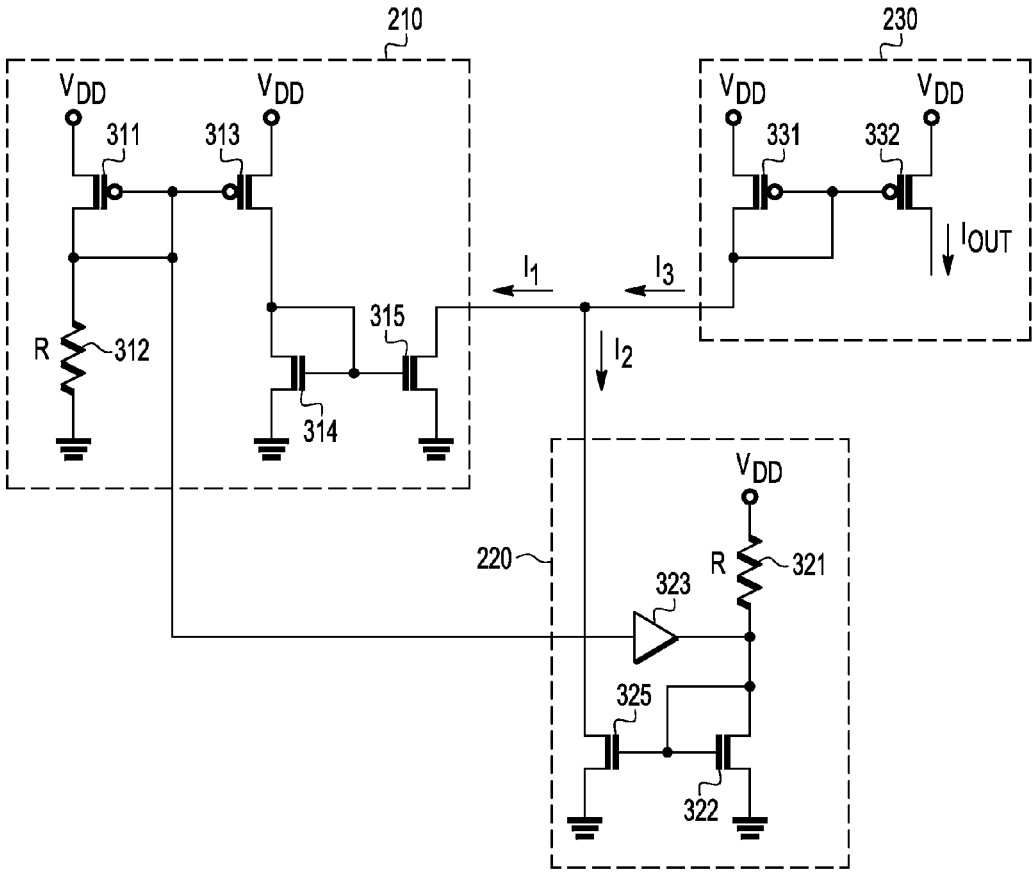
FIG. 3 illustrates in schematic form a current generator that may be used to implement the current generator of FIG. 2 according to some embodiments.

FIG. 3 illustrates in schematic form a current generator 300 that may be used to implement current generator 200 of FIG. 2 according to some embodiments. As shown in FIG. 3, current generator 300 generally includes a first current generator, a second current generator, and an output current generator, corresponding to current generators 210, 220, and 230 of FIG. 1, respectively, and indicated by like-numbered dashed boxes in FIG. 3.

The first current generator includes a P-channel MOS transistor 311, a resistor 312, a P-channel MOS transistor 313, and N-channel MOS transistors 314 and 315. Transistor 311 has a source connected to $V_{DD}$, a gate, and a drain connected to the gate thereof. Resistor 312 has a first terminal connected to the drain of transistor 311, and a second terminal connected to ground, and has an associated resistance R. Transistor 313 has a source connected to $V_{DD}$, a gate connected to the drain of transistor 311, and a drain. Transistor 314 has a drain connected to the drain of transistor 313, a gate connected to the drain thereof, and a source connected to ground. Transistor 315 has a drain for providing current $I_1$, a gate connected to the drain of transistor 314, and a source connected to ground.

The second current generator includes a resistor 321, an N-channel MOS transistor 322, a buffer 323, and an N-channel MOS transistor 325. Resistor 321 has a first terminal connected to $V_{DD}$, and a second terminal, and has an associated resistance substantially equal to R, the resistance of resistor 312. Transistor 322 has a drain connected to the second terminal of resistor 321, a gate connected to the drain thereof, and a source connected to ground. Buffer 323 has an input terminal connected to the gate of transistor 311, and an output terminal connected to the second terminal of resistor 321. Transistor 325 has a drain for providing current $I_2$, a gate connected to the drain of transistor 322, and a source connected to ground.

The output current generator includes P-channel MOS transistors 331 and 332. Transistor 331 has a source connected to $V_{DD}$, a gate, and a drain connected to the gate thereof and to the drains of transistors 315 and 325. Transistor 332 has a source connected to $V_{DD}$, a gate connected to the drain of transistor 331, and a drain for providing current $I_{OUT}$.

In general, current generators 210 and 220 provide currents $I_1$ and $I_2$ as described with reference to FIG. 2 above. In current generator 210, the current through resistor 312 is equal to the voltage at the drain and gate of transistor 311 divided by the resistance of resistor 312. Resistor 312 is sized so that transistor 311 operates in saturation, and thus $$I_1 = \frac{V_{DD} - V_{SG311}}{R_{312}} = \frac{V_{DD}}{R_{312}} - \frac{V_{SG311}}{R_{312}} \quad [2]$$

in which $V_{SG311}$ is the source-to-gate voltage of transistor 311 and $R_{312}$ is the resistance of resistor 312. Transistors 311 and 313 together form a P-channel MOS transistor current mirror to mirror a current proportional to $I_1$ through transistor 313 such that transistor 313 sources current $I_1$ at its drain, and transistors 314 and 315 form an N-channel MOS transistor current mirror such that transistor 315 sinks a current proportional to $I_1$ at its drain. If transistors 311 and 313 have equal sizes, and transistors 314 and 315 have equal sizes, then transistor 315 sinks a current substantially equal to $I_1$ at its drain.

In current generator 220, the current through resistor 321, $I_2$, is equal to:

$$I_2 = \frac{V_{SG311}}{R_{321}} \quad [3]$$

Currents $I_1$ and $I_2$ are summed at a common node to form current $I_3$. Using equations [2] and [3] to solve for $I_3$ yields:

$$I_3 = \frac{V_{DD}}{R_{312}} - \frac{V_{SG311}}{R_{312}} + \frac{V_{SG311}}{R_{321}} \quad [4]$$

If the resistors are carefully matched such that R312≈R321=R, then $I_3$ can be rewritten as:

$$I_3 = \frac{V_{DD}}{R} - \frac{V_{SG311}}{R} + \frac{V_{SG311}}{R} = \frac{V_{DD}}{R} \quad [5]$$

which exhibits the desired dependence on $V_{DD}$ and independence of transistor characteristics. Transistors 322 and 325 form an N-channel MOS transistor current mirror such that transistor 325 sinks a current proportional to $I_2$ at its drain. If transistors 322 and 325 have equal sizes, then transistor 325 sinks a current substantially equal to $I_2$ at its drain.

The output circuit is a current mirror formed by transistors 331 and 332 which provides $I_{OUT}$ proportional to $I_3$. If transistors 331 and 332 have the same width-to-length (W/L) ratios, then $I_{OUT}$=$I_3$. If they have different ratios, then $I_{OUT}$ is scaled to the ratio of the W/L of transistor 332 to the W/L of transistor 331. Thus the output circuit not only buffers the outputs of the first and second current generators, but also allows the user to scale the output current to a desired value.

Figure 4:
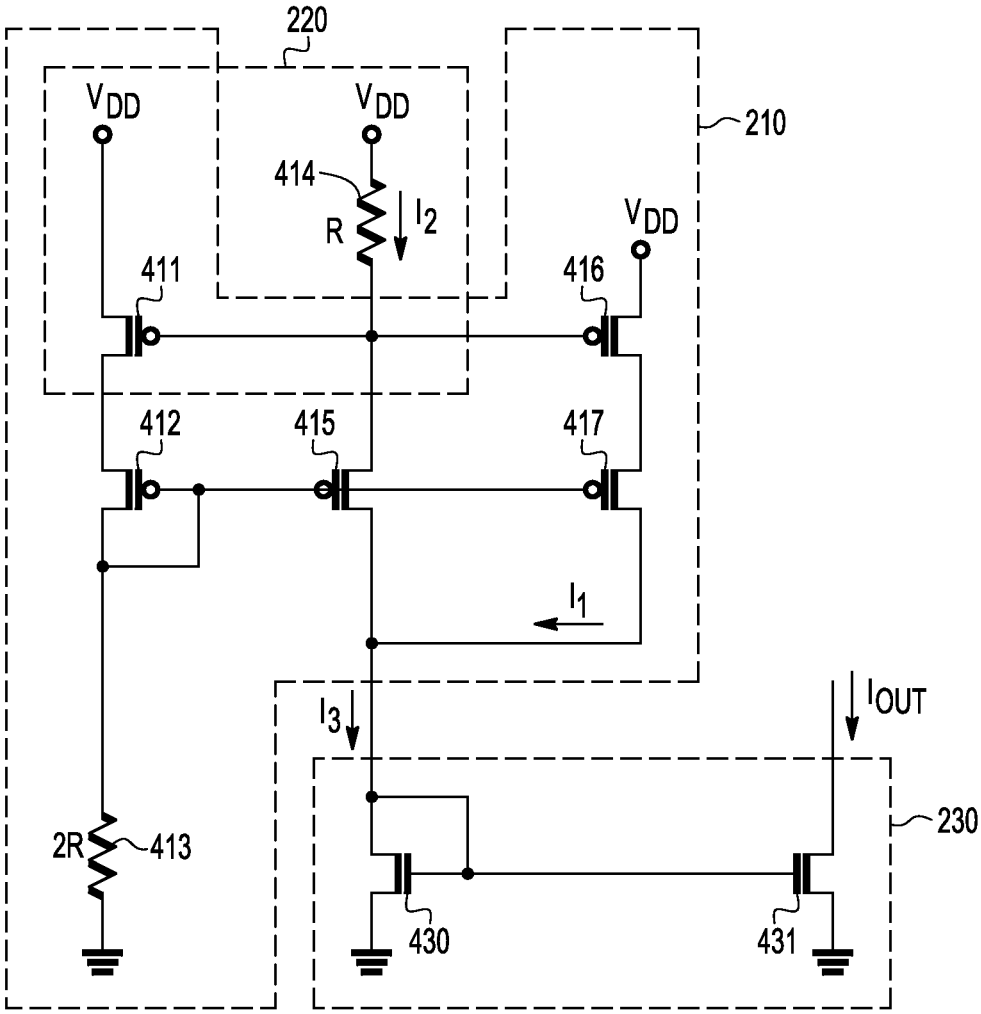
FIG. 4 illustrates in schematic form another current generator that may be used to implement the current generator of FIG. 2 according to some embodiments.

FIG. 4 illustrates in schematic form another current generator 400 that may be used to implement current generator 200 of FIG. 2 according to some embodiments. Note that current generator 400 has overlapping portions that form the first and second current generators and current generator 400 is useful in understanding how their functions may overlap. In addition current generator 400 uses cascode transistors to improve output impedance.

Current generator 400 includes P-channel MOS transistors 411 and 412, resistors 413 and 414, P-channel MOS transistors 415, 416, and 417, and N-channel MOS transistors 430 and 431. Transistor 411 has a source connected to $V_{DD}$, a gate, and a drain. Transistor 412 has a source connected to the drain of transistor 411, a gate, and a drain connected to the gate thereof. Resistor 413 has a first terminal connected to the drain of transistor 412, and a second terminal connected to ground, and has an associated resistance 2R. Resistor 414 has a first terminal connected to $V_{DD}$, and a second terminal connected to the gate of transistor 411. Transistor 415 has a source connected to the second terminal of resistor 414, a gate connected to the gate of transistor 412, and a drain for providing current I2. Transistor 416 has a source connected to $V_{DD}$, a gate connected to the second terminal of resistor 414, and a drain. Transistor 417 has a source connected to the drain of transistor 416, a gate connected to the gate of transistor 412, and a drain connected to the drain of transistor 415 for providing current $I_1$. Transistor 430 has a drain connected to the drains of transistors 415 and 417, a gate connected to the drain thereof, and a source connected to ground. Transistor 431 has a drain for sinking current $I_{Our}$, a gate connected to the gate of transistor 430, and a source connected to ground.

Current generator 400 is another implementation of current generator 200 of FIG. 2. Elements 411 and 414 correspond current generator 220, which establishes a current $I_2=V_{SG411}/R_{414}$ as before. Elements 411-413 and 415-417 correspond to current generator 210, which establishes a current $I_1$ equal to $(V_{DD}-V_{SG411}-V_{SG415})/R_{413}$. For transistors with high enough output impedances, setting their sizes the same and their bias currents the same will ensure their VSG voltages will be the same. When this is the case, $V_{SG411}=V_{sG415}=V_{SG}$. Further setting $R_{413}=2R_{414}$ and $R_{414}=R$, it can be shown that:

$$I_3 = I_1 + I_2 = \frac{V_{DD}}{2R} - \frac{2V_{SG}}{2R} + \frac{V_{SG}}{R} = \frac{V_{DD}}{2R} \quad [6]$$

Equation [5] holds to the extent that the $V_{SG}$ of transistor 411 matches the $V_{SG}$ of transistor 415 and the resistance of resistor 413 is twice as large as the resistance of resistor 414.

Note that current generator 400 requires fewer circuit elements than current generator 300. It uses transistors 411, 412, and 415-417 and resistor 413 to generate current $I_1$ by dropping two source-to-gate voltages from $V_{DD}$ and applying this voltage referenced to ground across resistor 413. It uses transistor 411 and resistor 414 to generate current $I_2$ by establishing the gate-to-source voltage of transistor 411 across resistor 414. Thus even with cascode transistors, current generator 400 requires only seven transistors and three unit resistors.

Note that current generator 400 is a current sink. Adding an additional P-channel MOS transistor current mirror to output current generator 230 could transform it into a corresponding current source.

Thus a current generator can be formed to generate a proportional-to-supply current by summing a first current proportional to a difference between a first power supply voltage and a gate-to-source voltage, and a second current proportional to the same gate-to-source voltage. The components related to the gate-to-source voltage can be canceled by close matching of transistor and resistor sizes. An output current proportional to the power supply voltage can then be generated from the sum of the first and second currents. The output current can either be made equal to the sum or proportional to the sum based on the sizes of the transistors in the current mirror. In this way, the current generator does not need a large operational amplifier with its bias circuitry or a complicated startup (since it is self-starting), and thus is small in area.

Any of the current generators of FIGS. 2-4 may be described or represented by a computer accessible data structure in the form of a database or other data structure which can be read by a program and used, directly or indirectly, to fabricate integrated circuits with the circuits of FIG. 2, 3, or 4. For example, these circuits may be drawn with a schematic capture tool which will generate a netlist or entered directly as a netlist. The netlist comprises a set of circuit elements which also represent the functionality of the hardware comprising an integrated circuit with the circuits of FIG. 2, 3, or 4. The netlist may then be laid out to produce a data set describing geometric shapes to be applied to masks. The masks may then be used in various semiconductor fabrication steps to produce integrated circuits using the circuits of FIG. 2, 3, or 4. Alternatively, the database on the computer accessible storage medium may be the netlist (with or without the synthesis library) or the data set, as desired, or Graphic Data System (GDS) II data.

While particular embodiments have been described, various modifications to these embodiments will be apparent to those skilled in the art. For example, other transistor types besides MOS transistors may be used in other embodiments. In addition, mirror images of the disclosed circuits could be formed by reversing the conductivity types of the transistors and reversing the power supplies. Moreover, as shown in FIG. 4, the first and second current generators could be formed with various combinations of overlapping circuit elements. The resistors described above may be formed by polysilicon resistors, or by other known resistor types or known resistor equivalents. For example, the resistors may be implemented by other linear resistor elements such as diffusion resistors, metal resistors, etc. They may also be implemented by MOS transistors biased in the triode region to act as resistors, or by switched capacitor resistor equivalents. Accordingly, it is intended by the appended claims to cover all modifications of the disclosed embodiments that fall within the scope of the disclosed embodiments.

What is claimed is:

1. A current generator comprising:

a first current generator having an output for providing a first current, said first current proportional to a difference between a first power supply voltage conducted by a first power supply voltage terminal and a first gate-to-source voltage and inversely proportional to a first resistance value of a first resistor; and a second current generator having an output for providing a second current, said second current proportional to a second gate-to-source voltage, wherein said second gate-to-source voltage is approximately equal to said first gate-to-source voltage and inversely proportional to a second resistance value of a second resistor; and an output current generator for providing an output current proportional to a sum of said first current and said second current.

2. The current generator of claim 1, wherein said first current generator comprises:

a first transistor having a first current electrode coupled to said first power supply voltage terminal, a control electrode, and a second current electrode coupled to said control electrode;

said first resistor having a first terminal coupled to said second current electrode of said first transistor, and a second terminal coupled to a second power supply voltage terminal; and a second transistor having a first current electrode coupled to said first power supply voltage terminal, a control electrode coupled to said second current electrode of said first transistor, and a second current electrode for providing said first current.

3. The current generator of claim 2, wherein said first current generator further comprises:

a current mirror coupled to said second power supply voltage terminal having an input terminal coupled to said second current electrode of said second transistor, and an output terminal for providing said first current.

4. The current generator of claim 3, wherein said current mirror comprises:

a third transistor having a first current electrode coupled to said second current electrode of said second transistor, a control electrode coupled to said first current electrode, and a second current electrode coupled to said second power supply voltage terminal; and a fourth transistor having a first current electrode for providing said first current, a control electrode coupled to said first current electrode of said third transistor, and a second current electrode coupled to said second power supply voltage terminal.

5. The current generator of claim 4, wherein said first power supply voltage terminal is more positive with respect to said second power supply voltage terminal, said first and second transistors are P-channel MOS transistors, and said third and fourth transistors are N-channel MOS transistors.

6. The current generator of claim 2, wherein said second current generator comprises:

said second resistor having a first terminal coupled to said first power supply voltage terminal, and a second terminal coupled to said second current electrode for providing said second current;

a buffer having an input terminal coupled to said second current electrode of said first transistor, and an output terminal coupled to said second terminal of said second resistor; and a current mirror having an input terminal coupled to said second terminal of said second resistor, and an output terminal forming said output of said second current generator.

7. The current generator of claim 1, wherein said output current generator comprises a current mirror.

8. The current generator of claim 7, wherein said output current generator comprises:

a seventh transistor having a first current electrode coupled to said first power supply voltage terminal, a control electrode, and a second current electrode coupled to said control electrode, said output of said first current generator, and said output of said second current generator; and an eighth transistor having a first current electrode coupled to said first power supply voltage terminal, a control electrode coupled to said second current electrode of said seventh transistor, and a second current electrode for providing said output current.

9. The current generator of claim 1, wherein each of said first current generator and said second current generator comprise transistors connected in a cascode configuration.

10. The current generator of claim 9, wherein said first current generator comprises:

a first transistor having a first current electrode coupled to said first power supply voltage terminal, a control electrode, and a second current electrode;

a second transistor having a first current electrode coupled to said second current electrode of said first transistor, a control electrode, and a second current electrode coupled to said control electrode;

said first resistor having a first terminal coupled to said second current electrode of said second transistor, and a second terminal coupled to a second power supply voltage terminal;

a third transistor having a first current electrode coupled to said control electrode of said first transistor, a control electrode coupled to said second current electrode of said second transistor, and a second current electrode;

a fourth transistor having a first current electrode coupled to said first power supply voltage terminal, a control electrode, and a second current electrode; and a fifth transistor having a first current electrode coupled to said second current electrode of said fourth transistor, a control electrode coupled to said second current electrode of said second transistor, and a second current electrode for providing said first current.

11. The current generator of claim 10, wherein said second resistor has a first terminal coupled to said first power supply voltage terminal, and a second terminal coupled to said control electrodes of said first and third transistors.

12. A current generator comprising:

a first transistor having a first current electrode coupled to a first power supply voltage terminal, a control electrode, and a second current electrode;

a second transistor having a first current electrode coupled to said second current electrode of said first transistor, a control electrode, and a second current electrode coupled to said control electrode;

a first resistor having a first terminal coupled to said second current electrode of said second transistor, and a second terminal coupled to a second power supply voltage terminal, wherein a first current flows through said first resistor;

a second resistor having a first terminal coupled to said first power supply voltage terminal, and a second terminal coupled to said control electrode of said first transistor;

a third transistor having a first current electrode coupled to said second terminal of said second resistor, a control electrode coupled to said second current electrode of said second transistor, and a second current electrode;

a fourth transistor having a first current electrode coupled to said first power supply voltage terminal, a control electrode coupled to said second terminal of said second resistor, and a second current electrode; and a fifth transistor having a first current electrode coupled to said second current electrode of said fourth transistor, a control electrode coupled to said second current electrode of said second transistor, and a second current electrode coupled to said second current electrode of said third transistor.

13. The current generator of claim 12, wherein a resistance of said first resistor is approximately equal to twice a resistance of said second resistor.

14. The current generator of claim 12, further comprising:

an output current generator for providing an output current proportional to a current received from said second current electrodes of said third and fifth transistors.

15. The current generator of claim 14, wherein said output current generator comprises:

a sixth transistor having a first current electrode coupled to said second current electrode of said third transistor, a control electrode coupled to said first current electrode thereof, and a second current electrode coupled to said second power supply voltage terminal; and a seventh transistor having a first current electrode for providing said output current, a control electrode coupled to said first current electrode of said sixth transistor, and a second current electrode coupled to said second power supply voltage terminal.

16. The current generator of claim 15, wherein a width-to-length ratio of said sixth transistor is approximately equal to a width-to-length ratio of said seventh transistor.

17. A method comprising:

generating a first current, said first current proportional to a difference between a first power supply voltage and a gate-to-source voltage and inversely proportional to a first resistance value of a first resistor; and generating a second current, said second current proportional to said gate-to-source voltage and inversely proportional to a second resistance value of a second resistor; and summing said first current and said second current to provide a third current.

18. The method of claim 17 further comprising:

generating an output current proportional to said third current.

19. The method of claim 18 wherein said generating said output current comprises mirroring said third current to provide said output current.

20. The method of claim 17 wherein said generating said first current comprises:

generating a reference voltage equal to a difference between said first power supply voltage and at least one gate-to-source voltage of at least one corresponding transistor;

applying said reference voltage to a first terminal of said first resistor; and applying a second power supply voltage to a second terminal of said first resistor.

* * * * *

UNITED STATES PATENT AND TRADEMARK OFFICE

CERTIFICATE OF CORRECTION

PATENT NO. : 9,024,682 B2
APPLICATION NO. : 14/010992
DATED : May 5, 2015
INVENTOR(S) : Krnic et al.

It is certified that error appears in the above-identified patent and that said Letters Patent is hereby corrected as shown below:

In the Specification:

In column 4, line 60, replace "$I_{Our}$," with "$I_{OUT}$,".

Signed and Sealed this
Twenty-second Day of March, 2016

Michelle K. Lee

Michelle K. Lee
*Director of the United States Patent and Trademark Office*